US009585446B1

(12) United States Patent
Scalzo

(10) Patent No.: US 9,585,446 B1
(45) Date of Patent: Mar. 7, 2017

(54) WEARABLE AND STOWABLE RING PROTECTOR

(71) Applicant: Eric Angelo Scalzo, Miami, FL (US)

(72) Inventor: Eric Angelo Scalzo, Miami, FL (US)

( * ) Notice: Subject to any disclaimer, the term of this patent is extended or adjusted under 35 U.S.C. 154(b) by 0 days.

(21) Appl. No.: 14/841,993

(22) Filed: Sep. 1, 2015

(51) Int. Cl.
*A44C 9/00* (2006.01)
*A44C 15/00* (2006.01)

(52) U.S. Cl.
CPC ..... *A44C 9/0092* (2013.01); *A44C 15/003* (2013.01)

(58) Field of Classification Search
CPC ..... A44C 9/0092; A44C 9/0084
USPC ..... 63/15.8
See application file for complete search history.

(56) References Cited

U.S. PATENT DOCUMENTS

| | | | | |
|---|---|---|---|---|
| 1,533,441 | A * | 4/1925 | Melling | A44C 9/0092 63/15.8 |
| 1,885,930 | A * | 11/1932 | Lowy | A44C 9/0092 63/15.8 |
| 7,654,111 | B2 * | 2/2010 | Alley | A44C 9/0092 63/15.8 |
| 2008/0148776 | A1 * | 6/2008 | Alley | A44C 9/0092 63/15.8 |
| 2012/0118016 | A1 * | 5/2012 | Maloney | A44C 9/0092 63/15.8 |
| 2013/0105336 | A1 * | 5/2013 | Haight | A45C 13/002 206/6.1 |

* cited by examiner

*Primary Examiner* — Emily Morgan

(57) ABSTRACT

Ring protector made of non-elastic or elastic materials produced by common manufacturing techniques including, but not limited to, 3D printing or by skilled hands, to snuggly fit around a ring and completely surround the outside of a ring and any incorporated designs, stones or settings. The ring protector may contain padding or cushion material within any design recess to further protect the ring and any incorporated designs, stones or settings. Ring protectors made according to principles of this invention protect rings from damage while the ring both on and off the ring-wearer's hand.

4 Claims, 3 Drawing Sheets

WEARABLE AND STOWABLE RING PROTECTOR

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM

Not Applicable

BRIEF SUMMARY OF THE INVENTION

This invention relates to jewelry, apparel and storage—more specifically—to a ring protector and the methods of protecting a ring while on the ring-wearer's hand and while off the ring-wearer's hand.

BACKGROUND OF THE INVENTION

Jewelry can be a significant investment for individuals and, in the case of certain jewelry such as class rings, championship rings, family heirlooms and engagement rings, can also carry substantial sentimental significance for jewelry owners and wearers. Due to the placement of a ring on a ring-wearer's body, a ring worn during daily activities can become damaged through physical contact to the ring with hard or abrasive surfaces. Similarly, due to their small size, rings that are stored off a ring-wearer's body (e.g., in bags, purses, pockets, jewelry boxes or drawers) have the real danger of becoming damaged though physical contact with other objects.

Such rings often include precious or semi-precious stones affixed to the ring through mechanical means such as settings which are known to skilled jewelers. The nature of how precious stones are affixed to rings make the risk of a stone becoming damaged, scratched, loosened, dislodged and ultimately lost real. Such risk is exacerbated when a ring comes into contact with hard or abrasive surfaces either on the ring-wearer's hand or while off the ring-wearer's hand.

Similarly, such rings often incorporate intricate or delicate designs that also risk damage when a ring comes into contact with hard or abrasive surfaces either on the ring-wearer's hand or while off the ring-wearer's hand.

Because of the risk damage to rings during every-day activities, there is a need for a ring protector that fits securely around a ring capable of protecting a ring and any incorporated designs, stones or settings while the ring is either on or off the ring-wearer's hand, Such ring protector should be capable of the following;

- being placed on or removed from a ring whether the ring on or of a ring-wearer's finger;
- remaining engaged on a ring whether the ring is on or off a ring-wearer's finger;
- remaining on a ring when the ring is removed from or placed on a ring-wearer's finger; and
- protecting a ring whether a ring-wearer is wearing the ring or not wearing the ring,

SUMMARY OF THE INVENTION

The invention presents a ring protector for protecting a ring while either worn upon a finger of a ring-wearer or while off a ring-wearer's hand, the ring protector comprising: a protective band composed of elastic or non-elastic materials including, but not limited to, plastics, composites or rubber-like plastics that fits snuggly around a ring including any incorporated designs, stones or settings, The invention is capable of being placed over a ring whether such ring is on or off a ring-wearer's hand. The invention is capable of remaining on such ring after the ring has been removed from a ring-wearer's hand for continued protection of the ring while the ring remains off of the ring-wearer's hand during storage or transport. Further, the invention is capable of being placed on a ring after such ring has been removed from a ring-wearer's hand for protection of the ring during storage or transport.

BRIEF DESCRIPTION OF THE DRAWINGS

The forgoing aspects and many of the attendant advantages of this invention will become more readily appreciated as the same become better understood by reference to the following detailed description, when taken in conjunction with the accompanying drawings, wherein.

DETAILED DESCRIPTION OF THE INVENTION

Figure 1:
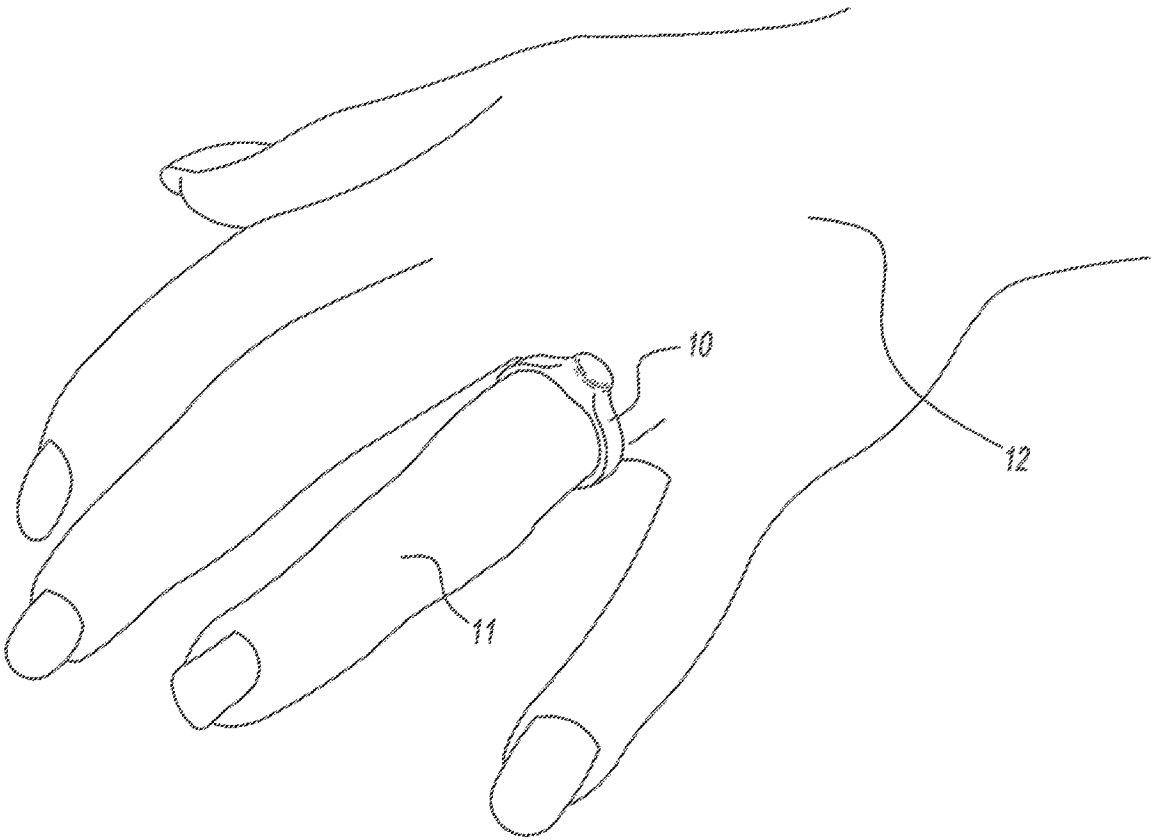
FIG. 1 shows one embodiment of a ring protector made according to the principles of the invention as worn on a finger of a hand.

FIG. 1 show one embodiment of a ring protector (10) made according to the principles of the invention. The ring protector (10) is shown as it would be worn over a ring (unseen) on the finger (11) of a hand (12). The ring protector (10) may be worn over a ring while on the finger (11) of the hand (12) or, as depicted in later drawings, the ring protector (10) may be used to protect a ring from damage while the ring is off a ring-wearer's finger. The ring protector (10) may be placed over a ring while the ring is on a ring-wearer's finger or while a ring is off a ring-wearer's finger. Similarly, the ring protector (10) may be removed from a ring while on a ring-wearer's finger or while a ring is off a ring-wearer's finger. Further, the ring protector (10) and ring can be placed on a finger or taken off a finger together, at the same time, when the ring protector (10) is engaged on a ring.

As depicted with reference to FIG. 1, the ring protector (10) is capable of being worn with a ring on the finger (11) and forms one continuous loop around both a ring and the finger (11).

Figure 2:
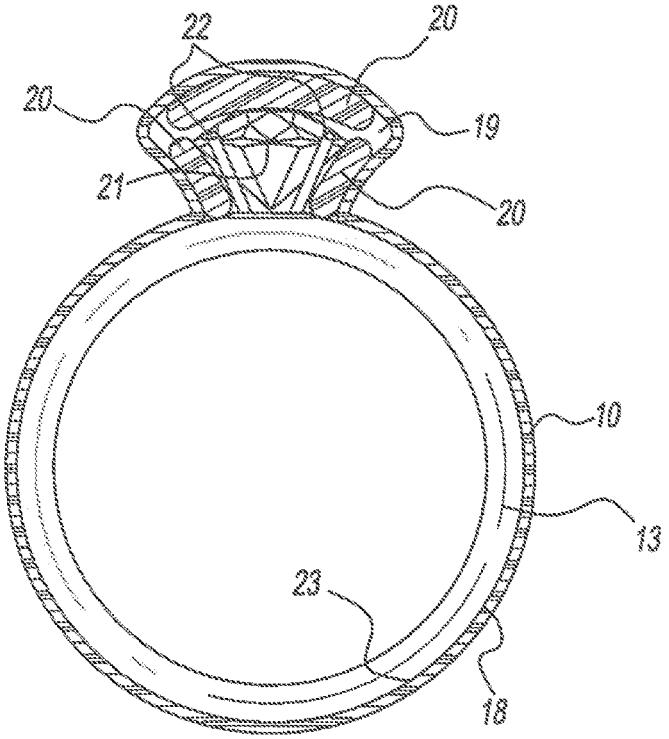
FIG. 2 is a cross-sectional, schematic view of one embodiment of a ring protector constructed according to principles of the invention, such embodiment is depicted as containing an example ring for illustration purposes.

With reference now to FIG. 2, the ring protector (10) is composed of one solid piece of material or materials that completely cover the outside of a ring (13) and which allows for ring (13) to be placed inside of the ring protector (10) and to be secured by the design of the ring protector or the pressure from the inherent elasticity of the material. The ring protector (10) may be at least partially comprised of material that is flexible. It is important to note that the material of the ring protector (10) need not be elastic to satisfy the design, and the exterior appearance of the ring protector (10) may, but does not need to remain unchanged when the ring (13) is engaged. in the ring protector (10) as when compared to its appearance when the ring (13) is not engaged in the ring protector (10). The ring protector (10) may be customized using manufacturing techniques including, but not limited to, 3D printing technologies to securely fit over the unique size, shape and configuration of any ring and therefore the size, shape and configuration of the ring protector (10) shall be defined by the size, shape and configuration of the ring (13). One of skill in the art will appreciate that the color and pattern of the ring protector (10) may be of a variety of configurations and patterns to decorate the ring protector (10) for aesthetic purposes and still act as a protective cover for the ring (13).

As best seen in FIG. 2, the interior surface of the ring protector (18) forms a complete loop around the ring (13), any design or stone (21) and setting mechanism(s) (22) incorporated into the ring (13), As depicted, the interior surface of the ring protector (18) may include at least one design recess (19) which may contain one or more pieces of protective padding or cushion material (20). Any design recess (19) shall he sized to receive a stone (21) and setting mechanism(s) (22) with any protective padding or cushion material (20), but could also receive a design that does not include stones or protective padding or cushion material. The design recess (19) may be of any size, shape or configuration to accept a ring's incorporated designs, stones or settings other than as depicted; the invention is by no means limited to rings with the depicted size, shape or configuration of design recess (19). Further, the invention is by no means limited to rings possessing designs, stones or settings and a ring protector may he configured to accept and protect rings with no designs, stones or settings such as, but not limited to, simple wedding bands. Similarly, the invention is by no means limited to rings possessing single stones and the ring protector (10) may he configured to accept and protect rings with multiple stones and settings such as, but not limited to, halo-style engagement rings.

As depicted in FIG. 2, the design recess (19) may also be equipped with at least one piece of padding or cushion material (20) capable of providing additional protection or support to the design or stone (21) or setting mechanism(s) (22). Such padding or cushion material (20) may be formed from a variety of commercially available padding or cushioning products. Padding or cushion material (20) need not be padding or cushion in the literal sense of the word, any material capable of being affixed to at least part of the interior surface of the ring protector (18) sufficient to protect the design or stone (21) or setting mechanism(s) (22) within the design recess (19) sufficient to protect any design or stone (21) or setting mechanism(s) (22) from shock, impact or damage will suffice as padding or cushion material (20). The size, shape and configuration of the padding or cushion, including the width and thickness of the padding or cushion and the number of pieces of padding or cushion may vary from this depiction depending on the size, shape and configuration of the ring (13), design or stone (21) or setting mechanism(s) (22) and still achieve the purpose and design of the invention. Such padding or cushion material (20) may be affixed to the inside pocket of the design recess (19) using a variety of conventional means, including but not limited to common glues or adhesives.

Figure 3:
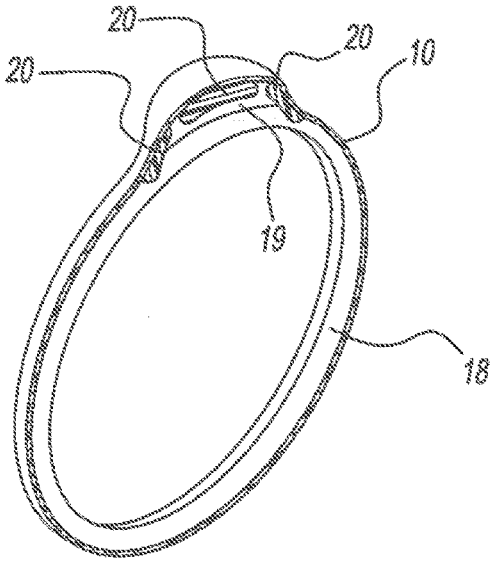
FIG. 3 is a cross-sectionals schematic view of one embodiment of a ring protector constructed according to the principles of the invention.
Figure 4:
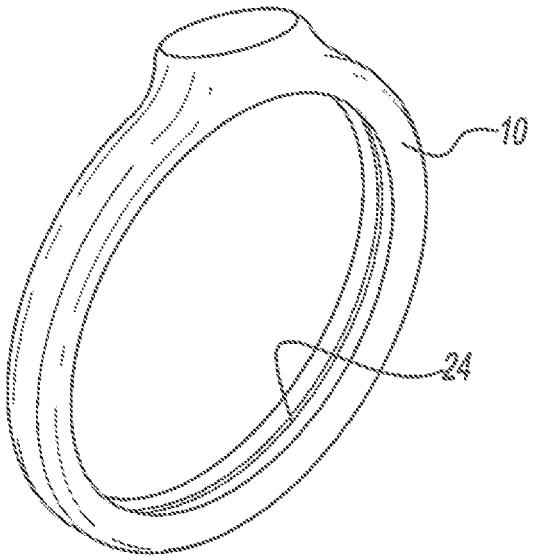
FIG. 4 shows one embodiment of a ring protector made according to the principles of the invention.

With continuous reference to FIG. 2 and with reference to FIG. 3, the ring protector (10), with the exception of the optional padding or cushion material (20) will be constructed from one solid piece of material. The interior surface of the ring protector (18) will be produced such that the ring protector (10) will lay directly on the exterior surface of the ring (23) and follow the natural curvature and design of that ring, and the interior surface of the ring protector may contain a design recess (19) to accommodate any attached designs, stones or setting mechanisms of the ring such that the design or stone (21) or setting mechanism (s) (22) will fit within the design recess (19).

As best illustrated in FIG, 4, the ring protector (10) as displayed by itself, is capable of accepting a ring by inserting a ring into the ring protector (10) and its ring channel (24)

Figure 5:
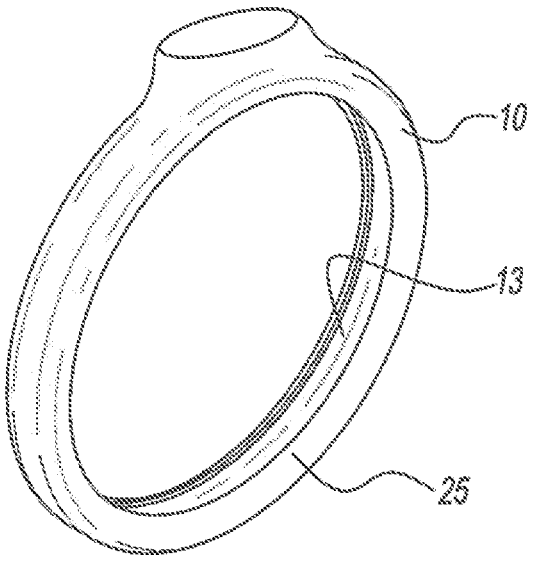
FIG. 5 shows one embodiment of a ring protector made according to the principles of the invention, such embodiment is depicted as containing an example ring for illustration purposes.

With reference now to FIG. 5, the ring protector (10) is displayed on the ring (13) and off a finger. As depicted, the ring protector (10) remains significantly in the same position on the ring (13) as depicted in FIG. 1 when worn on the finger (11). The sides of the ring protector (25) may, but do not need to, cover the sides of the ring (13) and the side of any incorporated designs, stones or setting mechanism(s) (as seen in FIG. 2) such that if laid on its side, the ring protector (10) would continue to protect the ring (13) from damage. It is important to note that the ring protector (10) need not fully cover the sides of the ring or any incorporated design, stone or setting to achieve the purpose and design of the invention.

As depicted by comparison of FIGS. 1 and 5, the design and sizing of the ring protector (10) allows for the ring protector to be worn with the ring (13) on the finger (11), for the ring protector (10) to remain on the ring (13) when taken off of the finger (11) and for the ring protector (10) to be placed on the ring (13) when already off of the finger (11).

While one embodiment of the invention has been illustrated and described herein, it will be appreciated that various changes can be made therein without departing from the spirit and scope of the invention. Though one embodiment of the invention has been illustrated and described herein, the invention shall not be limited to the size, shape or configuration of the embodiment depicted and the invention is intended for use with any and all designs, shapes, sizes or configurations of rings and any incorporated designs, stones or setting mechanism(s).

The embodiments of the invention in which an exclusive property or privilege is claimed are defined as follows:

1. A ring protector for protecting a ring, the ring including a band having an inside surface, and outside surface, and side edges therebetween, and a protruding design, the ring protector comprising:

a protective band having a continuous interior surface, an inner recess defined in the interior surface, the inner recess is configured to surround the outside surface and at least a portion of the side edges of the ring;

one or more design recess included in the inner recess, the one or more design recess shaped to receive the protruding design of the ring when the band is received in the inner recess; and one or more pieces of cushion material positioned in the one or more design recess.

2. The ring protector of claim 1, wherein the ring protector is capable of surrounding the ring when the ring is worn, and when the ring is not worn.

3. The ring protector of claim 1, wherein ring protector comprises a material from the group consisting of: elastic, plastic-like or rubberized plastic material, wherein the material is continuous without a seam.

4. The ring protector of claim 1, wherein the material of the one or more cushions is configured to protect the protruding design from damage, impact, or shock.

* * * * *